US007152990B2

(12) United States Patent
Kukuk

(10) Patent No.: US 7,152,990 B2
(45) Date of Patent: Dec. 26, 2006

(54) MULTI-FUNCTIONAL LAW ENFORCEMENT TOOL

(75) Inventor: Craig Allen Kukuk, Boise, ID (US)

(73) Assignee: Craig Kukuk, Boise, ID (US)

( * ) Notice: Subject to any disclaimer, the term of this patent is extended or adjusted under 35 U.S.C. 154(b) by 206 days.

(21) Appl. No.: 10/775,316

(22) Filed: Feb. 10, 2004

(65) Prior Publication Data

US 2004/0184260 A1 Sep. 23, 2004

Related U.S. Application Data

(63) Continuation-in-part of application No. 10/139,582, filed on May 3, 2002, now Pat. No. 7,004,597, and a continuation-in-part of application No. 09/699,846, filed on Oct. 29, 2000, now Pat. No. 6,499,855.

(51) Int. Cl.
*F41G 1/34* (2006.01)

(52) U.S. Cl. ..... 362/112; 362/96; 362/109; 362/114; 362/253; 222/79; 222/113; 361/232

(58) Field of Classification Search ..... 362/96, 362/109, 111, 112, 114, 234, 208, 253; 361/232; 222/79, 113; 89/1.11
See application file for complete search history.

(56) References Cited

U.S. PATENT DOCUMENTS

| | | | | |
|---|---|---|---|---|
| 2,629,516 | A * | 2/1953 | Badham | 222/79 |
| 4,186,851 | A | 2/1980 | Cantor | 222/113 |
| 4,842,277 | A | 6/1989 | LaCroix | 273/84 ES |
| 6,237,461 | B1 * | 5/2001 | Poole | 89/1.11 |
| 6,386,726 | B1 | 5/2002 | Macierowski et al. | 362/102 |
| 6,394,622 | B1 * | 5/2002 | Macek | 362/96 |
| 6,666,566 | B1 * | 12/2003 | Uke | 362/109 |

* cited by examiner

*Primary Examiner*—Stephen F Husar

(57) ABSTRACT

A multifunctional law enforcement tool, preferably includes several of the tools needed by law enforcement and security personnel. In one embodiment the multifunctional tool comprising a flashlight, stun gun, deterrent spray, glass breaker, I.D. holder, deterrent spray stun and cartridge housings. The cartridge housings allow the user to fire non-lethal rounds such as stun, bean bag, rubber bullets, balls and other projectiles. It may also fire tactical rounds such as colored smoke, breach rounds and concussion rounds. The cartridge housings may also house other battery powered devices such as cameras, audio and video recorders. In a second embodiment the cartridge housings are removed for a lighter more compact unit.

8 Claims, 9 Drawing Sheets

MULTI-FUNCTIONAL LAW ENFORCEMENT TOOL

This application is a continuation in part of U.S. application Ser. No. 09/699,846 filed Oct. 29, 2000, now U.S. Pat. No. 6,499,855 B1 and Patent Ser. No. 10/139,582 entitled Multi-Functional Law Enforcement Tool Filed May 3, 2002, now U.S. Pat. No. 7,004,597, herein incorporated by reference.

BACKGROUND OF THE INVENTION

1. Field of the Invention

This invention relates generally to law enforcement and security personnel. More specifically, this invention relates to different combinations of a flashlight, deterrent spray, stun gun, deterrent spray stun (for example, Taser™), glass breaker, I.D. holder and numerous non lethal and tactical cartridge capabilities and an orthogonal handle.

2. Related Art

U.S. Pat. No. 4,186,851 (Cantor) discloses a combination flashlight and deterrent spray.

U.S. Pat. No. 6,386,726 (Macierowski) discloses a combination flashlight, baton, pepper spray.

U.S. Pat. No. 4,842,277 (LaCroix) discloses a combination flashlight and stun gun.

Still, there is a need for a compact but effective multifunctional law enforcement tool with a flashlight, stun gun, deterrent spray, glass breaker, I.D. holder, deterrent spray stun with multiple non lethal and tactical cartridge housings. This invention will address the needs of law enforcement and security personnel.

SUMMARY OF INVENTION

The invention is a multifunctional law enforcement tool that may serve an officers need to have various features and options quickly at hand, while keeping the officers gun hand free. In one embodiment, the invention comprising a flashlight, deterrent spray, stun gun, glass breaker, I.D. holder, deterrent spray stun with cartridge housings for all non lethal and tactical cartridges with an orthogonal handle. In another embodiment, the cartridge housings are removed thus making a smaller, lighter and more concealable unit.

The invented multifunctional law enforcement tool allows several important devices to be easily at hand for law enforcement and security personnel in a single unit. By having all the tools combined into one unit this leaves the users gun hand always free. Also, the invented multifunctional tool places both offensive and defensive tools together in the users hands along with the flashlight. Having all the commonly used tools ready immediately, greatly increases an officers options when dealing with the uncertainties of a suspects behavior. The officers may approach a suspect with the invented multifunctional tool in one hand, and his other hand ready at his gun, an may respond to a suspects behavior as appropriate. The user need not whisk out a stun gun, pepper spray can, stun gun or any other tool that he may need. These actions may be threatening and confrontational and may escalate the situation. Instead, he can hold and use the multifunctional law enforcement tool as a flashlight, which is a non threatening action, while having the other defensive and offensive tools ready for use. Thus, the invented combinations allow the user to be more in control of the situation, and ready for many turn of events.

Another object of the invented multifunctional law enforcement tool is to eliminate the need of several different objects (spray, stun gun, flashlight, glass breaker, etc.), to be clipped separately onto an officers belt. This eliminates the "clutter" of the separate objects, and reduces total weight because the invention may weigh significantly less by about 2 or 3 pounds, than the total of the separate objects. Also, for a female officer with a small waist, it is difficult to position the separate objects around her belt.

Another possible use of the invented multifunctional tool is with airline security. These non lethal options will help detain or incapacitate confrontational passengers where more lethal alternatives would be less appropriate.

DESCRIPTION OF THE PREFERRED EMBODIMENTS

Referring to the figures, these are depicted several but not all, embodiments of the present invention, which is a multifunctional law enforcement tool. In the following description of the preferred embodiment, the term proximal refers to the end containing the flashlight, stun gun and deterrent spray stun. Because of the typical use of the invention with the flashlight pointing "Forward" from the user, the flashlight end is also "Forward" direction and the I.D. holder, actuator button, and switches will be referred to as the "Rearward" direction. The glass breaker located at the "Bottom" of the handle will be referred to as the "Bottom" direction.

Figure 1:
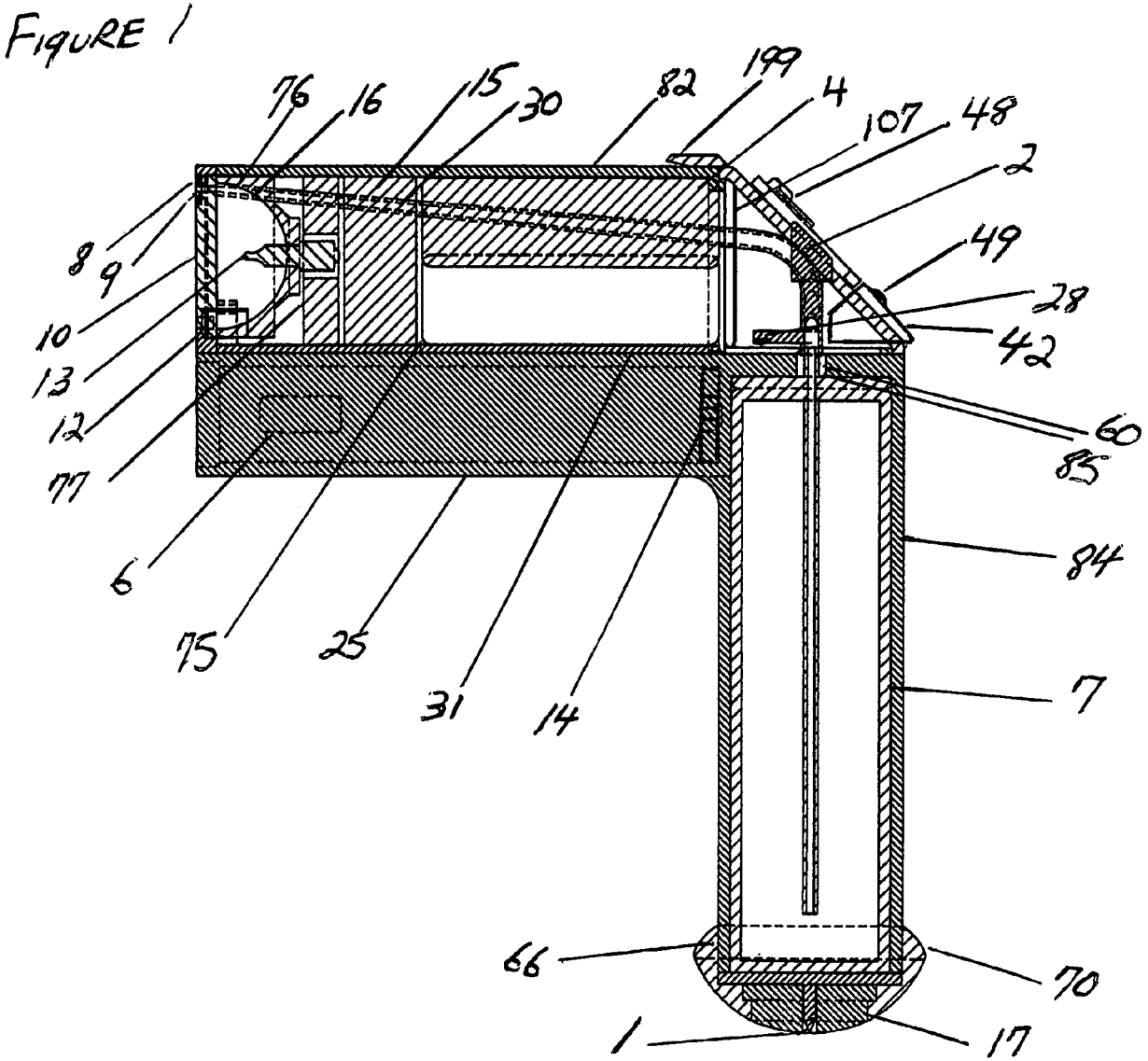
FIG. 1 Depicts a cross section view of invention.

FIG. 1 depicts a first embodiment of the invented multifunctional law enforcement tool, which comprises a handle unit. According to these Figures, FIG. 1 comprises an exterior shell 82 and a handle 84. Orthogonal handle 84 preferrably extends integrally from exterior shell 82 wherein handle 84 houses a deterrent spray canister 7. Deterrent spray canister 7 is pushed up through access port 66 internally until canister stem 60 passes through stem hole 85. Deterrent spray canister 7 is held in place by threaded glass breaker housing 70 which also houses glass breaker tip 1, can rubber compression unit 17. When screwed into place threaded glass breaker housing 70 keeps access port 66 watertight. When rubber compression unit 17 is struck against glass it will compress leaving glass breaker tip 1, exposed to strike against said glass. Once broken decreased pressure against rubber compression unit 17 will allow it to regain its normal shape and to cover glass breaker tip 1.

The location of handle 84 on exterior shell 82 is determined from balance, weight and center of gravity considerations. Preferably the handle 84 and exterior shell 82 will be equal in length on FIG. 1 and the handle 84 will be approximately 25% longer than the exterior shell 82 of FIG. 2.

Figure 5:
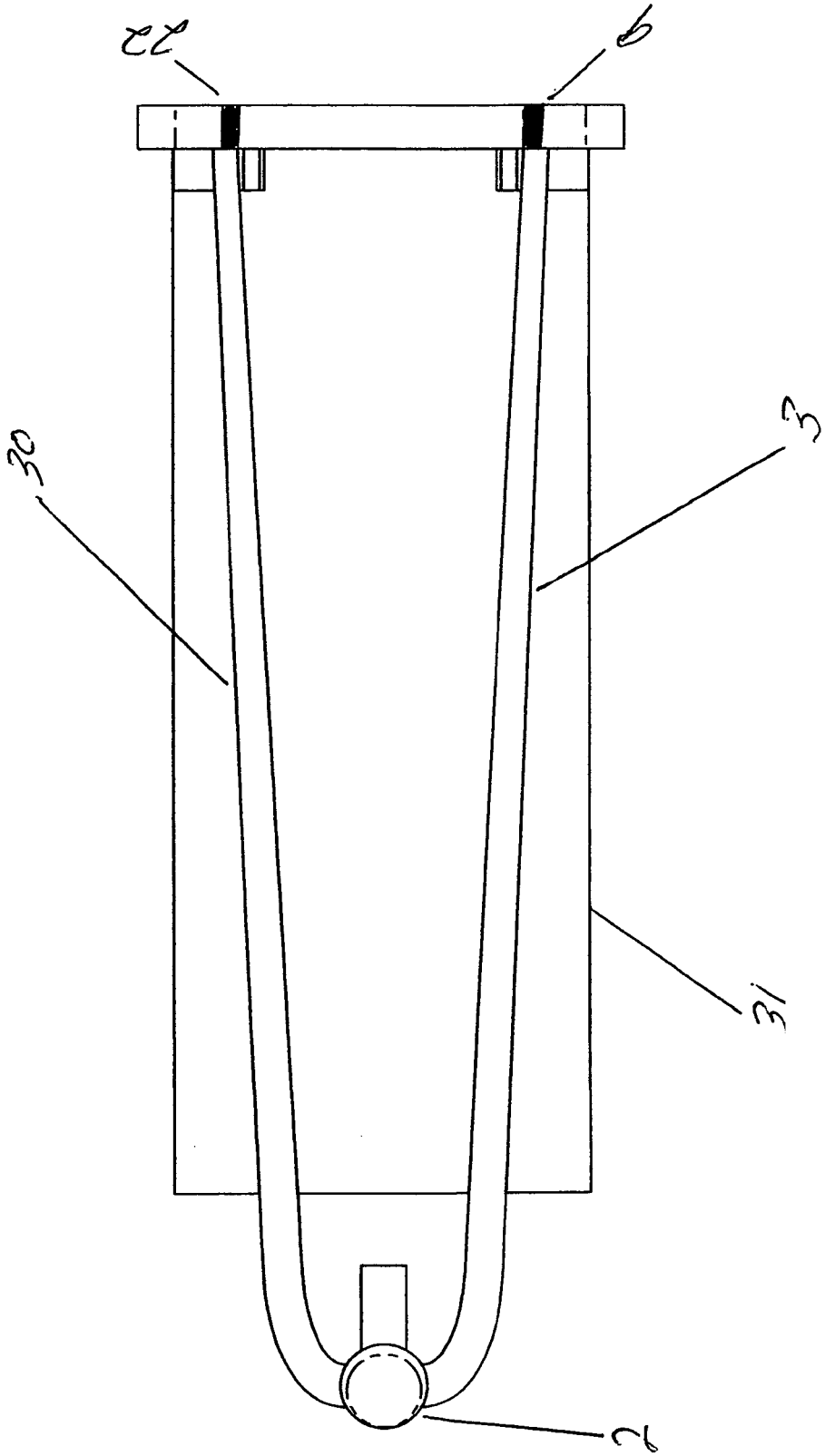
FIG. 5 Depicts an overview of actuator tubes, actuator valve and circuit board.

The exterior shell 82 of FIG. 1 possesses 3 internal cavities. Upper cavity 75 houses battery Pack 4 in its most rearward section. Electrical transformer 15, circuit board, bulb holder 77 and flashlight bulb 13 are located in the middle of upper cavity 75. In the most forward section of upper cavity 75 is the ends cover unit 76, which houses a parabolic reflector 16, laser sights 20 and 12 of FIG. 3 and stun gun probes 8 and 21 of FIG. 3. The lens cover unit 76 of FIG. 1 houses flashlight lens 10. Upper cavity 75 has an electronics tray 31 and deterrent spray tubes 3 and 30 of FIG. 5 which starts at the most rearward section of upper cavity 75 to the most forward section of upper cavity 75.

Figure 3:
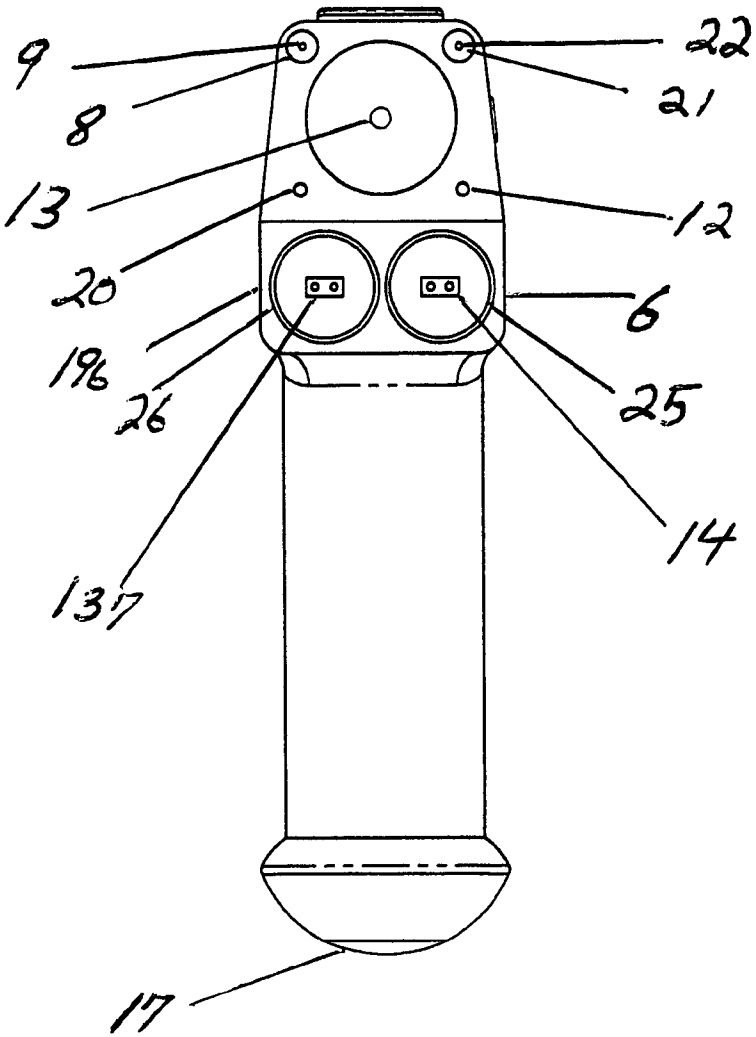
FIG. 3 Depicts a perspective view of FIG. 1.

In FIG. 3, deterrent spray exit ports 22 and 9 are designed to propel deterrent spray in 2 high pressure straight parallel lines into the eyes, mouth or facial region of a suspect or suspects deterrent spray exit ports 22 and 9 are located inside of stun gun probes 8 and 21. Deterrent spray actuator button 2 or FIG. 1 must be pushed to initiate deterrent spray forward through deterrent spray tubes 3 and 30 of FIG. 5.

Stun gun probes 8 and 21 of FIG. 3, are metal contacts that surround deterrent spray exit ports 22 and 9. The user may activate the stun gun feature by pushing the stun gun rocker switch 42 of FIG. 1 down. Instantly a high voltage arc will be visible between stun gun probes 8 and 21 of FIG. 3. The user may disable an attacker by simply touching the attacker with as much as but not limited to 400,000 volts, causing a neuromuscular disruption.

Figure 6:
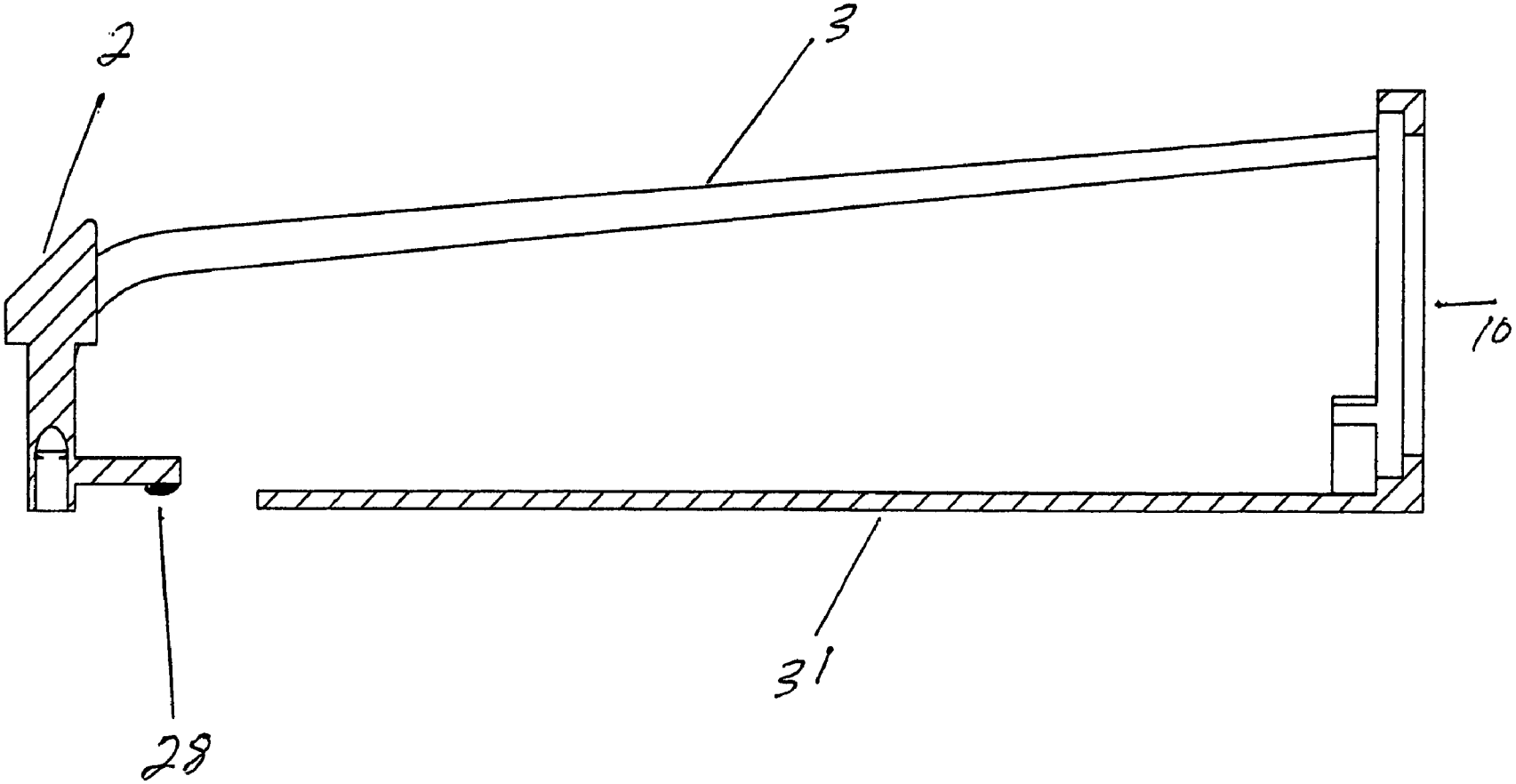
FIG. 6 Depicts a cross section view of deterrent spray actuator and stun gun contact.
Figure 7:
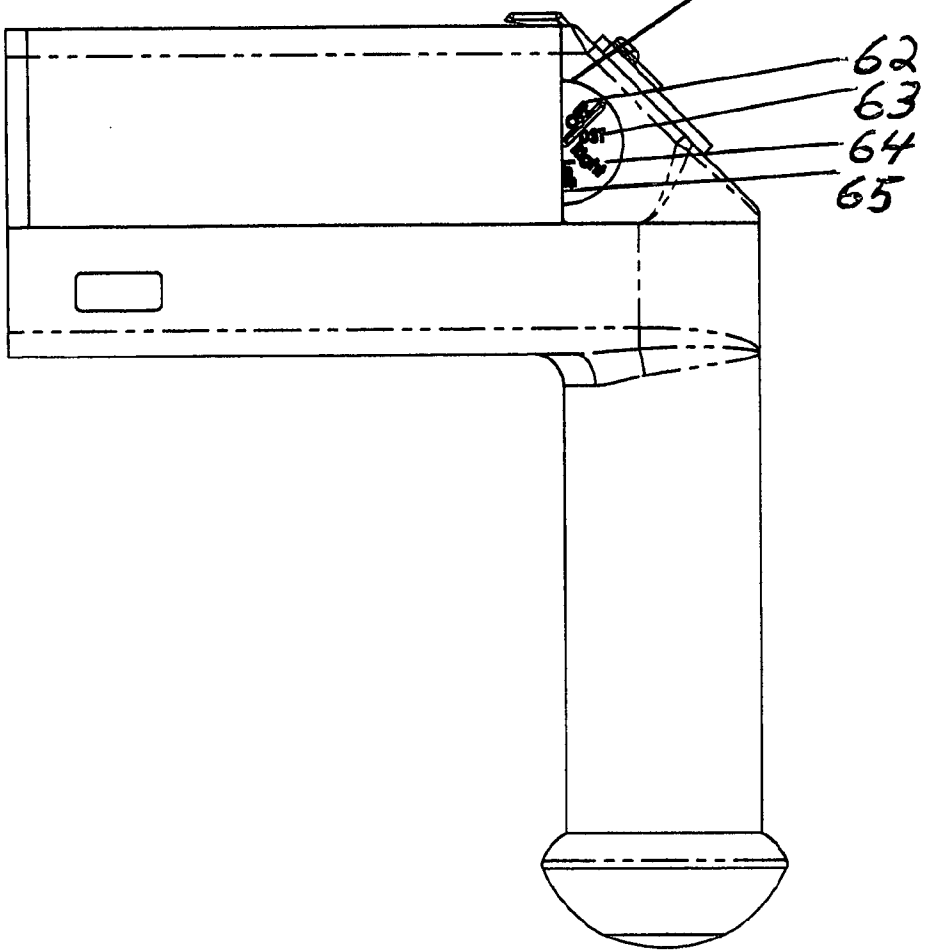
FIG. 7 Depicts a perspective view of "side switch" of FIG. 1.

In FIG. 7, 4 position switch 108 controls laser sights 20 and 12 of FIG. 3. When turned from "off" position 62 to position 63 of FIG. 7, the laser sights 20 and 12 will be activated to align the target. First position 63 or the D.S.T. mode permits electrical current to activate stun gun contact 28 of FIG. 6, which is affixed to the underside of deterrent spray actuator button 2 of FIG. 6, if pushed in a downward manner by the user. By activating position 63 of FIG. 7, the user may now effectively push down deterrent spray actuator button 2 of FIG. 1 and simultaneously activate the stun gun and deterrent spray modes by doing this the user has activated the D.S.T. feature. The D.S.T. feature is a bi-product of the stun gun high voltage arc and the two high pressure deterrent spray streams. The high voltage arc which normally occurs between stun gun probes 8 and 21 of FIG. 3 is intercepted by the conductive deterrent spray stream as they exit the deterrent spray exit ports 22 and 9 of FIG. 3. This combination propels an exposed high voltage arc along two high pressure straight lines of deterrent spray, in much the same way stun guns shoot two metal darts with conductive wire at a target. The suspects body completes the circuit between the two streams of deterrent spray and high voltage arc causing a neuromuscular disruption. The microprocessor 107 of FIG. 1 and accompanying electronics provide a pulse of electrical energy which may last as long but not limited to 5 seconds. The user must continue to manually hold down the deterrent spray button 2 of FIG. 1 or the high voltage arc will be ineffective as D.S.T but still effective as a stun gun.

By combining the effectiveness of a deterrent spray and a high voltage stun will make for an extremely effective non lethal solution. The D.S.T., because of its teatherless nature may be more effective against multiple suspects. People wearing heaving clothing may be shot in the face by the D.S.T. but not by current stun guns. The D.S.T. dual laser sights 20 and 12 of FIG. 3 make it easy to point and shoot.

In FIG. 1, parabolic reflector 16 and flashlight bulb 13 join together to create a flashlight with up to but not limited to 20,000 candlepower. Flashlight button 49 of FIG. 1 may be held down manually for intermittant use or slide switch 48 of FIG. 1 may be pushed in an upward motion to automatically hold flashlight button 49 down.

In FIG. 3, exterior shell 82 possess two lower cavities. Cartridge housings 25 and 26 of FIG. 3, are non lethal and tactical cartridge housings that may be activated by first manually moving the 4 position switch 108 of FIG. 7 to either right "64" or left "65", then pressing the stun gun switch 42 of FIG. 1. By doing this the user sends an electrical current to electrical connectors 14 and 137 of FIG. 3, which then electrically stimulates the cartridge being used. Cartridge clip hole 6 of FIG. 1 and cartridge clip hole 196 and 6 of FIG. 3 secure the cartridges into place. Small plastic tabs on the cartridge housings expand through clip hole 6 and 196. To remove a spent cartridge the user must compress the plastic tab on cartridge and then slide out in a forward manner. Non lethal and tactical cartridges such as bean bags, tasers, colored smoke etc. will be activated through the electrical connector 14 and 137 of FIG. 3 which engage the electrical contacts on the back of the cartridge only after activating stun gun switch 42 of FIG. 1. First, the cartridge which carry an explosive charge of gun powder and an electrical connection coupled together to create a controlled explosion which propels a projectile forward once stun gun switch 42 of FIG. 1 is activated. The user can then change 4 position switch 108 of FIG. 7 to fire another cartridge either right "64" or left "65" of FIG. 7. By switching cartridges the user will simultaneously be switching laser sights that correspond with the proper cartridge. Cartridges other than tactical and non lethal rounds may be used and powered by the battery pack 4 of FIG. 1.

Figure 9:
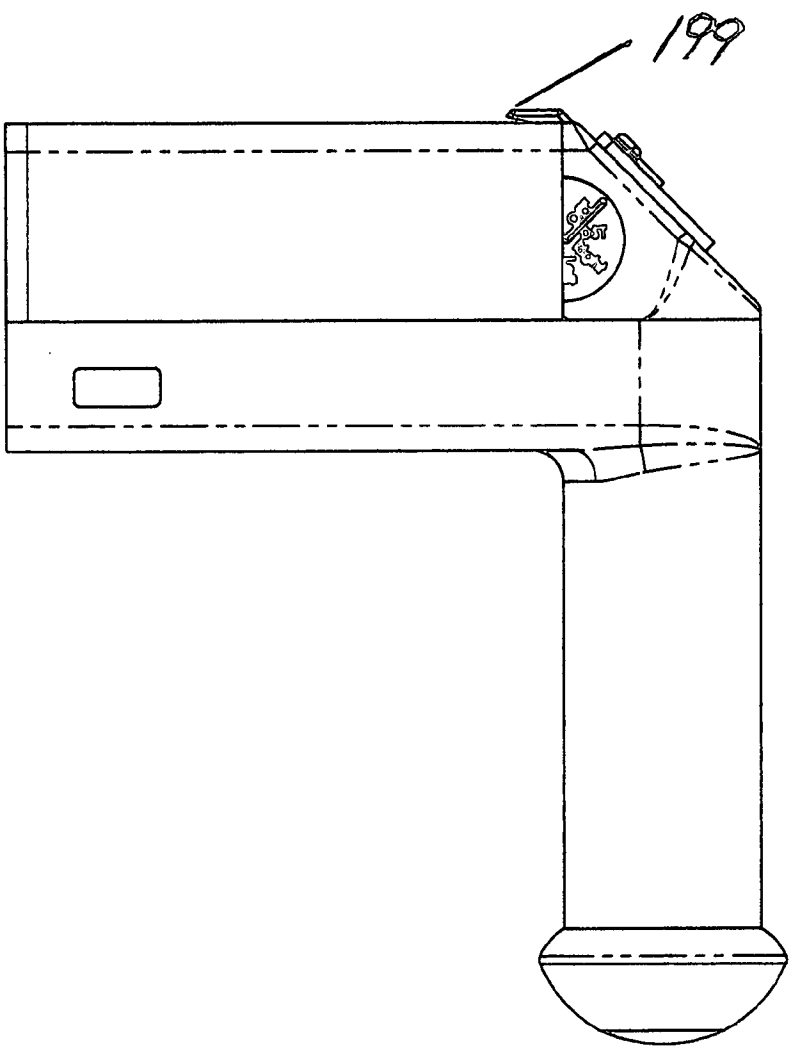
FIG. 9 Depicts a perspective view of I.D. holder.

FIG. 9 depicts an identification card clip 199 located at the rearward section of the exterior shell 82. This allows an officer to hold the identification card in the identification card clip instead of occupying his gun hand.

Figure 2:
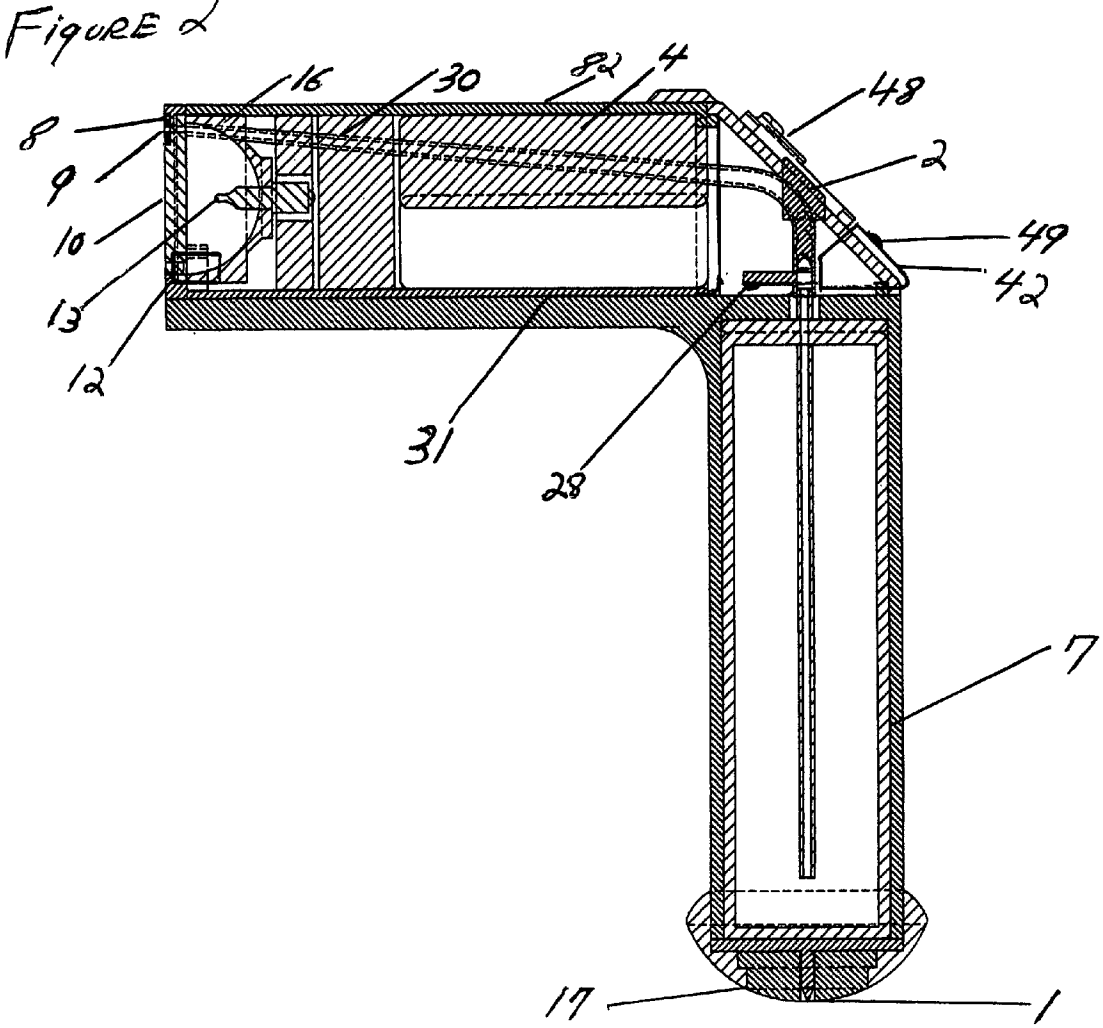
FIG. 2 Depicts the embodiment of FIG. 1 without cartridge housings.
Figure 4:
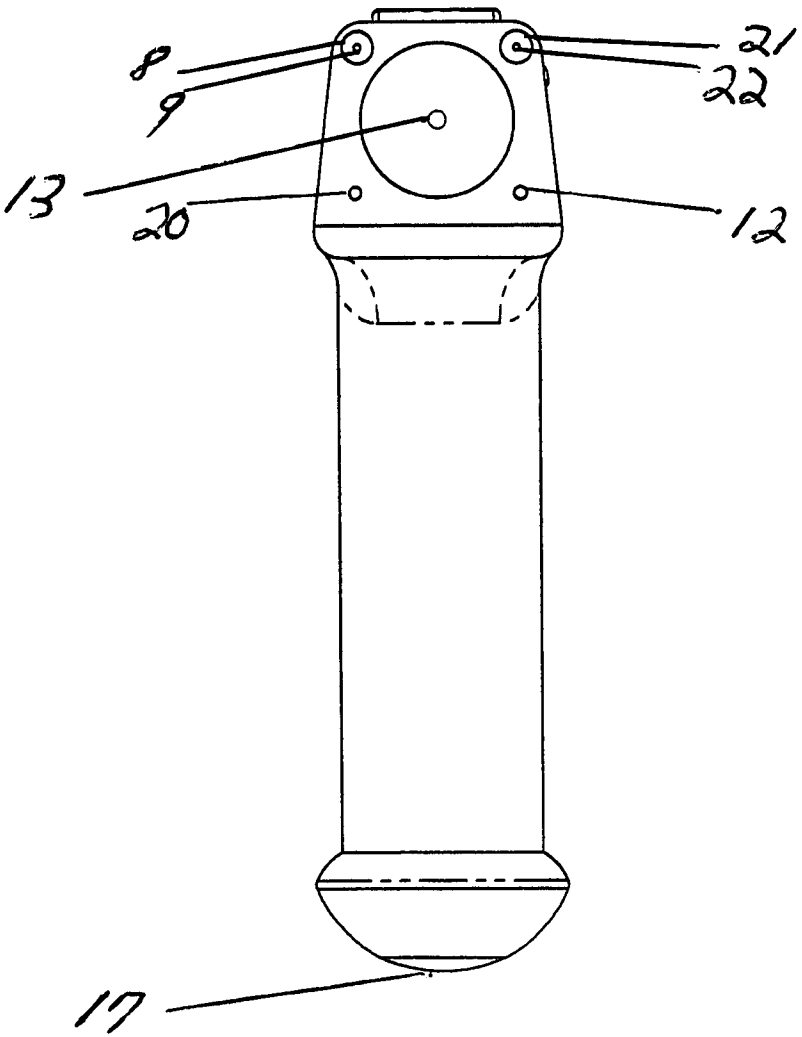
FIG. 4 Depicts a perspective view of FIG. 2.
Figure 8:
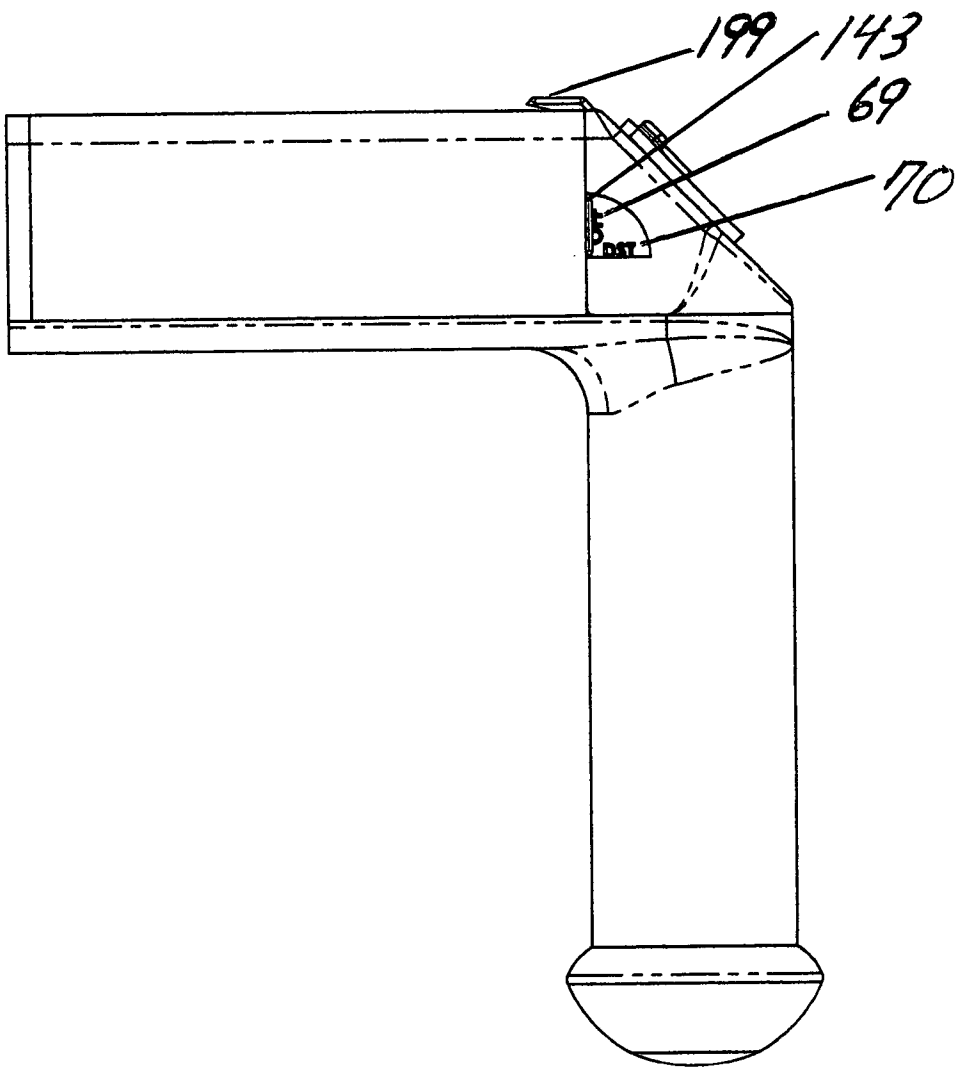
FIG. 8 Depicts a perspective view of FIG. 2's "side switch".

In the second embodiment of the multifunctional law enforcement tool, FIG. 2 depicts a unit without cartridge housings 25 and 26. FIG. 8 depicts a two stage switch 143 which includes a first "off" position 69 and a second position "70" for the D.S.T. feature. The rest of the multifunctional law enforcement tool of FIGS. 2, 4 and 8 remains unchanged from that of FIG. 1 of the first embodiment.

The invention claimed is:

1. A multifunctional law enforcement tool comprising: a handle unit comprising an elongated member on a longitudinal axis with a distal end and a proximal end and a handle generally orthogonally to the longitudinal axis near the proximal end of the elongated member, wherein the handle houses a deterrent spray canister and an interchangeably connectable glass breaking mechanism and wherein said elongated member houses a flashlight, stun gun, laser sights and deterrent spray nozzles at the distal end, and an identification card holder at the proximal end.

2. A multifunctional law enforcement tool comprising: a handle unit comprising an elongated member on a longitudinal axis with a distal end and a proximal end, and a handle generally orthogonally to the longitudinal axis near the proximal end of the elongated member, wherein the handle houses a deterrent spray canister and an interchangeably connectable glass breaking mechanism and wherein said elongated member houses a flashlight, stun gun, laser sights, deterrent spray nozzles and a deterrent spray stun mechanism at the distal end, and an identification card holder at the proximal end.

3. The multifunctional law enforcement tool of claim 2, wherein the deterrent spray stun mechanism delivers an exposed electrical charge to a target.

4. The multifunctional law enforcement tool of claim 3, wherein a plurality of liquid deterrent spray streams provides for an exposed electrical charge to complete a circuit between target and power source upon impact with the target.

5. A multifunctional law enforcement tool comprising: a handle unit comprising an elongated member on a longitudinal axis with a distal end and a proximal end, and a handle generally orthogonally to the longitudinal axis near the proximal end of the elongated member, wherein the handle houses a deterrent spray canister and an interchangeably connectable glass breaking mechanism and wherein said elongated member houses a flashlight and stun gun mechanisms at its distal end adjacent to tubular cartridge housings also on a longitudinal axis.

6. A multifunctional law enforcement tool comprising: a handle unit comprising an elongated member on a longitudinal axis with a distal end and a proximal end, and a handle generally orthogonally to the longitudinal axis near the proximal end of the elongated member, wherein the handle houses a deterrent spray canister and an interchangeably connectable glass breaking mechanism and wherein said elongated member houses a flashlight, stun gun and laser sights at its distal end adjacent to tubular cartridge housings also on a longitudinal axis.

7. A multifunctional law enforcement tool comprising: a handle unit comprising an elongated member on a longitudinal axis with a distal end and a proximal end, and a handle generally orthogonally to the longitudinal axis near the proximal end of the elongated member, wherein the handle houses a deterrent spray canister and an interchangeably connectable glass breaking mechanism and wherein said elongated member houses a flashlight, stun gun, laser sights and a deterrent spray stun mechanism at its distal end adjacent to tubular cartridge housings also on a longitudinal axis.

8. A multifunctional law enforcement tool comprising: a handle unit comprising an elongated member on a longitudinal axis with a distal end and a proximal end, and a handle generally orthogonally to the longitudinal axis near the proximal end of the elongated member, wherein the handle houses a deterrent spray canister and an interchangeably connectable glass breaking mechanism and wherein said elongated member houses a flashlight, stun gun, laser sights and a deterrent spray stun mechanism at its distal end and an identification card holder at the proximal end wherein said elongated member also houses a plurality of cartridge housings also on a longitudinal axis.

* * * * *